US006840615B2

(12) United States Patent
Pan et al.

(10) Patent No.: US 6,840,615 B2
(45) Date of Patent: Jan. 11, 2005

(54) IMAGING SURFACE FIELD RECONDITIONING METHOD AND APPARATUS

(75) Inventors: David H. Pan, Rochester, NY (US); Ralph A. Mosher, Rochester, NY (US); James E. Williams, Penfield, NY (US); Richard J. Blum, Webster, NY (US)

(73) Assignee: Xerox Corporation, Stamford, CT (US)

( * ) Notice: Subject to any disclaimer, the term of this patent is extended or adjusted under 35 U.S.C. 154(b) by 11 days.

(21) Appl. No.: 10/320,828

(22) Filed: Dec. 16, 2002

(65) Prior Publication Data

US 2004/0114018 A1 Jun. 17, 2004

(51) Int. Cl.[7] ..... B41J 2/01
(52) U.S. Cl. ..... 347/103; 347/101; 347/104
(58) Field of Search ..... 347/85, 88, 101, 347/103, 104

(56) References Cited

U.S. PATENT DOCUMENTS

| | | | | |
|---|---|---|---|---|
| 4,636,803 A | | 1/1987 | Mikalsen | 346/1.1 |
| 4,739,339 A | | 4/1988 | DeYoung et al. | 346/1.1 |
| 5,038,157 A | | 8/1991 | Howard | 346/140 R |
| 5,168,289 A | * | 12/1992 | Katakabe et al. | 347/213 |
| 5,372,852 A | | 12/1994 | Titterington et al. | 427/288 |
| 5,683,638 A | * | 11/1997 | Crigler et al. | 264/71 |
| 5,793,397 A | * | 8/1998 | Barker et al. | 347/88 |
| 6,053,608 A | | 4/2000 | Ishii et al. | 347/88 |
| D453,787 S | | 2/2002 | Mattern | D18/56 |

* cited by examiner

*Primary Examiner*—Kristal J. Feggins
*Assistant Examiner*—An H. Do
(74) *Attorney, Agent, or Firm*—Tallam I. Nguti

(57) ABSTRACT

An imaging surface field reconditioning method and apparatus are provided for reconditioning, in the field, a marking material control pattern on an imaging surface of in an image producing machine. The imaging surface field reconditioning apparatus for practicing the method includes (a) an abrading device including an abrasive member having an abrasive surface; (b) a drive assembly for moving the imaging surface of the imaging member along a first plane; (b) a first moving device for moving the abrading surface of the abrading member into contact with the imaging surface for forming a surface reconditioning nip therewith; and (d) at least a second moving device for simultaneously moving the abrading surface along the first plane, and translating the abrading surface back and forth against said imaging surface along a second plane, for reconditioning the marking material control pattern on the imaging surface, thereby preventing marking material drawback during subsequent image formation, and thereby improving imaging quality.

20 Claims, 3 Drawing Sheets

IMAGING SURFACE FIELD RECONDITIONING METHOD AND APPARATUS

RELATED CASE

This application is related to U.S. application Ser. No. 10/320,824 entitled "Phase Change Ink Image Producing Machine Including An Imaging Member Having A Textured Imaging Surface" filed on even date herewith, and having at least one common inventor.

BACKGROUND OF THE INVENTION

This invention relates generally to image producing machines, and more particularly to an imaging surface field reconditioning method and apparatus and a high-speed phase change ink image producing machine or printer using same.

In general, phase change ink image producing machines or printers employ phase change inks that are in the solid phase at ambient temperature, but exist in the molten or melted liquid phase (and can be ejected as drops or jets) at the elevated operating temperature of the machine or printer. At such an elevated operating temperature, droplets or jets of the molten or liquid phase change ink are ejected from a printhead device of the printer onto a printing media. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

An example of such a phase change ink image producing machine or printer, and the process for producing images therewith onto image receiving sheets is disclosed in U.S. Pat. No. 5,372,852 issued Dec. 13, 1994 to Titterington et al. As disclosed therein, the phase change ink printing process includes raising the temperature of a solid form of the phase change ink so as to melt it and form a molten liquid phase change ink. It also includes applying droplets of the phase change ink in a liquid form onto an imaging surface in a pattern using a device such as an ink jet printhead. The process then includes solidifying the phase change ink droplets on the imaging surface, transferring them the image receiving substrate, and fixing the phase change ink to the substrate.

Conventionally, the solid form of the phase change is a "stick", "block", "bar" or "pellet" as disclosed for example in U.S. Pat. No. 4,636,803 (rectangular block 24, cylindrical block 224); U.S. Pat. No. 4,739,339 (cylindrical block 22); U.S. Pat. No. 5,038,157 (hexagonal bar 12); U.S. Pat. No. 6,053,608 (tapered lock with a stepped configuration). Further examples of such solid forms are also disclosed in design patents such as U.S. Design Pat. No. D453,787 issued Feb. 19, 2002. In use, each such block form "stick", "block", "bar" or "pellet" is fed into a heated melting device that melts or phase changes the "stick", "block", "bar" or "pellet" directly into a print head reservoir for printing as described above.

Conventionally, phase change ink image producing machines or printers, particularly color image producing such machines or printers, are considered to be low throughput, typically producing at a rate of less than 30 prints per minute (PPM). The throughput rate (PPM) of each phase change ink image producing machine or printer employing solid phase change inks in such "stick", "block", "bar" or "pellet" forms is directly dependent on how quickly such a "stick", "block", "bar" or "pellet" form can be melted down into a liquid. The quality of the images produced depends on such a melting rate, and on the types and functions of other subsystems employed to treat and control the phase change ink as solid and liquid, the imaging member and its surface, the printheads, and the image receiving substrates.

There is therefore a need for a relatively high-speed phase change ink image producing machine or printer that is also capable of producing relatively high quality images, particularly color images on plain paper substrates.

SUMMARY OF THE INVENTION

In accordance with the present invention, there is provided an imaging surface field reconditioning method and apparatus are provided for reconditioning, in the field, a marking material control pattern on an imaging surface of in an image producing machine. The imaging surface field reconditioning apparatus for practicing the method includes (a) an abrading device including an abrasive member having an abrasive surface; (b) a drive assembly for moving the imaging surface of the imaging member along a first plane; (b) a first moving device for moving the abrading surface of the abrading member into contact with the imaging surface for forming a surface reconditioning nip therewith; and (d) at least a second moving device for simultaneously moving the abrading surface along the first plane, and translating the abrading surface back and forth against said imaging surface along a second plane, for reconditioning the marking material control pattern on the imaging surface, thereby preventing marking material drawback during subsequent image formation, and thereby improving imaging quality.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
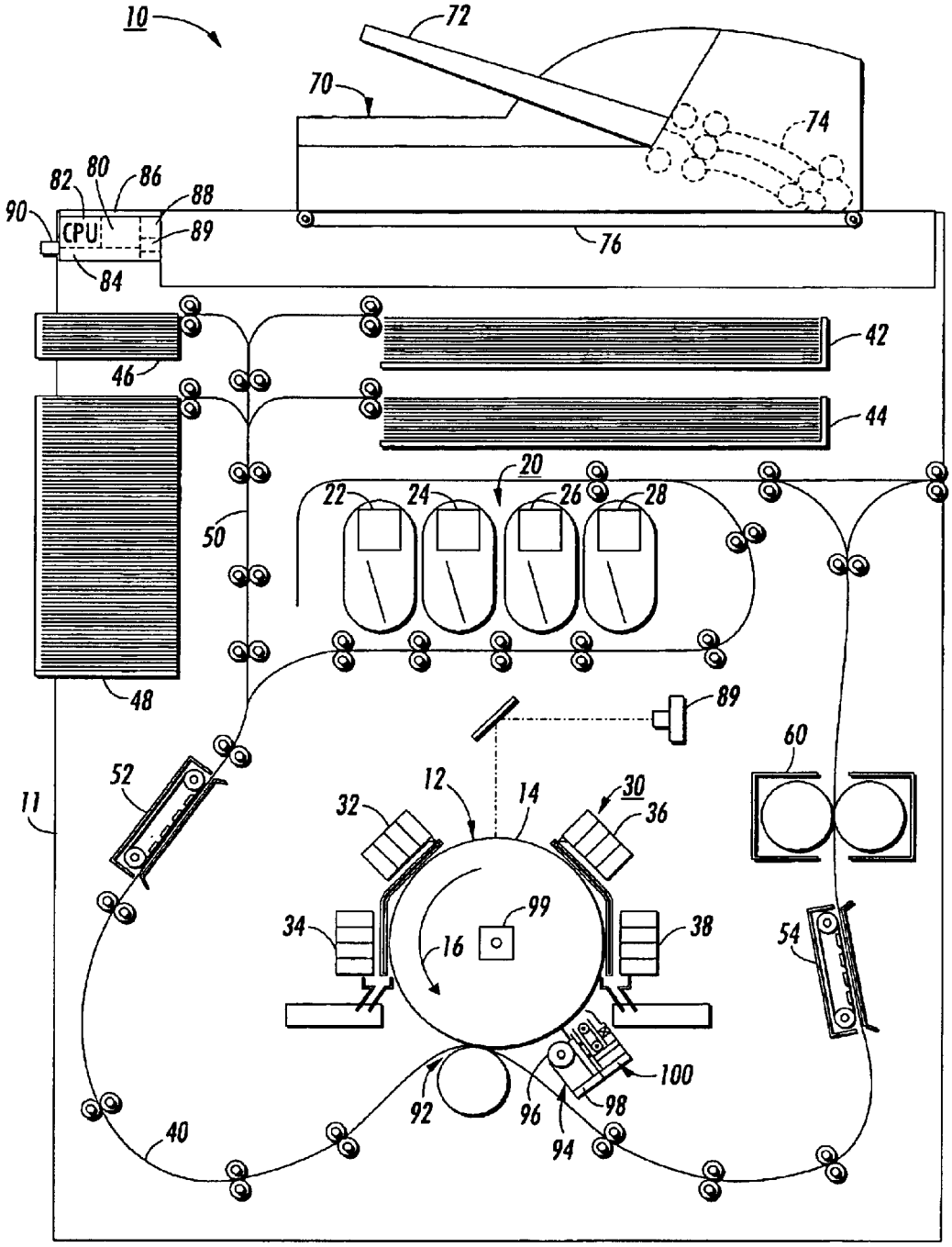
FIG. 1 is a vertical schematic of an exemplary high-speed phase change ink image producing machine including a maintenance assembly employing the field imaging surface reconditioning method and apparatus of the present invention.
Figure 2:
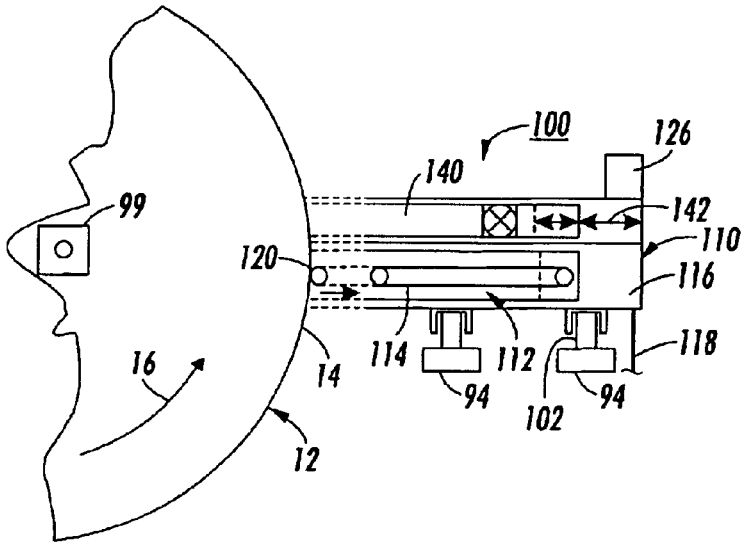
FIG. 2 is an illustration of the field imaging surface reconditioning apparatus of the present invention.
Figure 3:
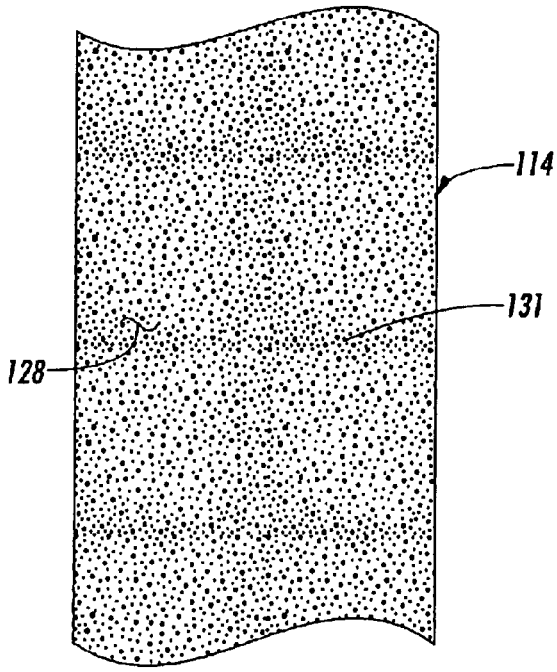
FIG. 3 is an illustration of a portion of the abrading surface of field imaging surface reconditioning apparatus of FIG. 2.
Figure 4:
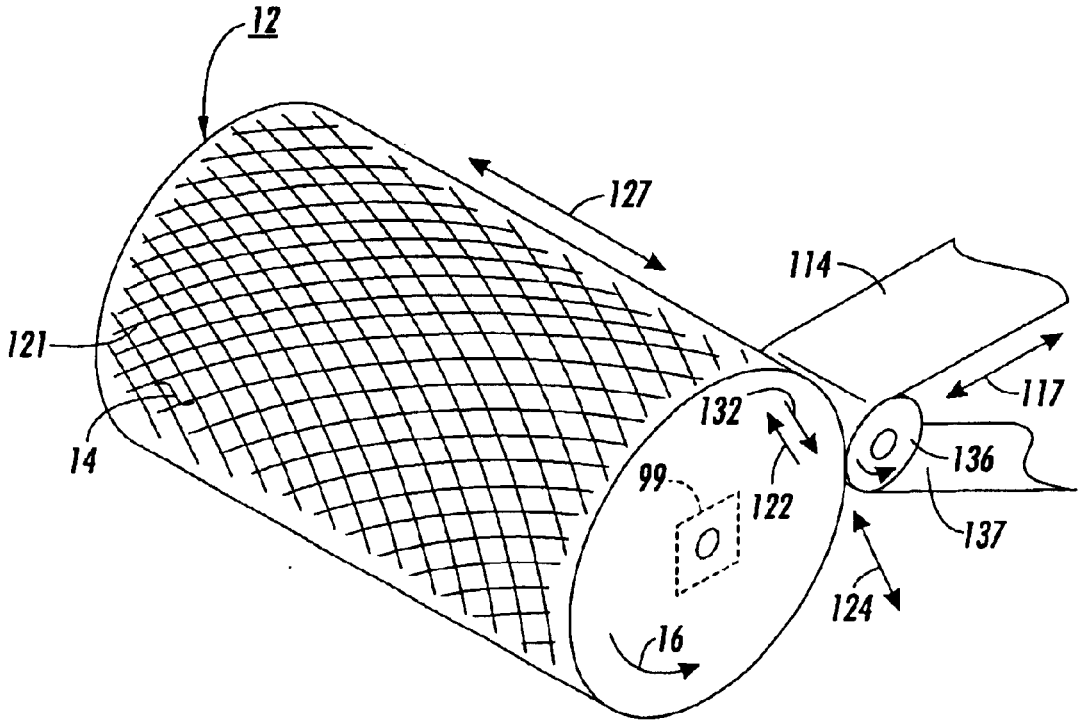
FIG. 4 is a schematic illustration of the field imaging surface reconditioning apparatus and method in accordance with the present invention.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The high-speed phase change ink image producing machine or printer 10 also includes a phase change ink delivery subsystem 20 that has at least one source 22 of one color phase change ink in solid form. Since the phase change ink image producing machine or printer 10 is a multicolor image producing machine, the ink delivery system 20 includes four (4) sources 22, 24, 26, 28, representing four (4) different colors CYMK (cyan, yellow, magenta, black) of phase change inks. The phase change ink delivery system also includes a melting and control apparatus (not shown in FIG. 1) for melting or phase changing the solid form of the phase change ink into a liquid form, and for then supplying the liquid form to a printhead system 30 including at least one printhead assembly 32. Since the phase change ink image producing machine or printer 10 is a high-speed, or high throughput, multicolor image producing machine, the printhead system includes four (4) separate printhead assemblies 32, 34, 36 and 38 as shown.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32, 34, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Still referring now to FIG. 1, in order to maintain the quality of images produces as such, the image producing machine 10 includes a maintenance assembly 94 that employs imaging surface field reconditioning method and apparatus 100 of the present invention. The maintenance assembly 94 includes an oiling roller 96 that is movable by moving means 98 into and out of oiling engagement with the imaging surface 14 of the imaging drum 12.

Referring now to FIGS. 1–4, the imaging member or drum 12 is movable for example by means 99 in the direction 16. As further illustrated, the imaging surface 14 may have formed therein a marking material flow control or flow restriction pattern or texture 121 for preventing liquid ink marking material for example from flowing backwards given a forward direction of movement of the surface 1. In the case of a phase change ink image producing machine that includes the imaging member (offset printing drum 12), the surface texture 121 of the offset printing drum is an important consideration for enabling continuous quality printing. This is because the surface texture 121 acts to pin individual liquid ink droplets to prevent what is referred to in the art as "ink drawback".

As discussed above, in operation, release oil is applied to the surface 14 by oiling roller 96 for example in order to facilitate image release therefrom. Then liquid or molten ink images are formed on the surface 14, pinned in place by the surface texture 121, and subsequently transferred under pressure within transfer nip or transfer station 92 onto an image receiving substrate. During the imaging process as such, an original surface texture 121, particularly of compliant surface 14, gradually wears away thereby causing the surface 14 to eventually deviate substantially from the predetermined surface texture, and if not reconditioned, polished. This loss of surface texture 121 inhibits droplet pinning and leads to marking material drawback. This reduces image quality and manifests itself as areas void of ink or as mottled areas in the final image. Ordinarily, to recondition or resurface such a worn imaging surface of an imaging drum, the subsystem or entire machine has to be sent back to a remanufacturing site, disassembled, and new or reconditioned components installed.

In accordance with an aspect of the present invention, the imaging surface field reconditioning method and apparatus 100 comprises a cartridge 110 that can be mount on rails 102, for example on the maintenance assembly 94, and that remains in the machine for use in the field after machine installation. As shown, the cartridge 110 is movably mounted on the rails 102, and includes an abrading device 112 having a movable endless abrasive belt 114. As shown, (FIG. 3), the abrasive belt 114 has an abrasive surface 128 including a desired grit rating within a range of from about 200 to 1200 in order to prevent further polishing the surface 14 or excessively wearing out the surface 14. The cartridge 110 also includes first drive means 116 connected by means 118 to the controller 80 (FIG. 1) for selectively moving (arrow 117) the abrading device 112 out, away from the imaging surface 14, and in, into nip contact therewith to form a reconditioning nip 120. The out and in movement of the abrading device 12 can be programmed to occur at predetermined intervals based for example on a number of images formed and transferred from the surface 14. The cartridge 110 further includes a second drive means 126 that is also connected to the controller 80 (FIG. 1) for translating or moving (arrow 127) the abrading device 112 longitudinally relative to the surface 14. A third drive means 136 of the cartridge 110 also connected to the controller 80 can simultaneously also move the abrasive belt 114 of the abrading device 112 in the direction 137.

As such, within the reconditioning nip 120, the surface 14 is being moved at a first reconditioning speed, in a first direction 122 and along a first plane 124. Within the same nip 120, the abrasive belt 114 is being moved at a second reconditioning speed, in a second direction 132, and along the same first plane 124. Simultaneously, the entire cartridge 110, (and hence abrading device 112 and abrasive belt 114), are being translated at a third speed, along a second plane shown by the arrow 127. The traversing or translating third speed can be synchronized to the first moving (rotational) speed of the spinning imaging drum 12 for achieving and maintaining a desired reconditioned texture or pattern 121.

The method of reconditioning the imaging surface 14 in accordance with the present invention thus includes (a) moving the imaging surface of the imaging member 12 along a first plane 124, (b) cleaning release oil, marking material residue and debris from the imaging surface 14, and (c) moving an abrading surface 128 of the abrasive belt 114 into contact with the surface 14 for forming a surface reconditioning nip 120. The method then includes (d) simultaneously moving the abrading surface 128 along the first plane 124, and translating the abrading surface back and forth along a second plane 127, for reconditioning the marking material control pattern 121 on the imaging surface 14. This thereby prevents marking material drawback during subsequent image formation and improving imaging quality.

This method thus restores or rejuvenates (after machine installation and in the field), the surface 14 on the drum 12 to a specific pre-determined texture 121, which will prevent ink drawback and maintain image quality. This apparatus for this method thus consists of the removable cartridge 110 that can be moved (117) into contact with the surface 114 forming the nip 120, and can be traversed back and forth (127) across the surface 14 of the imaging drum 12. The cleaning function for example may comprise using a dedicated oil wiper (not shown) or it may comprise running a number of blank sheets through the image transfer station 92 without imaging on the imaging surface 14 and without oiling the imaging surface as with oiling roller 96.

As further shown, the cartridge 110 includes a vacuum device 140 (FIG. 2) that is mounted adjacent the abrading device 112 for removing abraded debris from the reconditioning nip 120. As shown, the vacuum device 140 is movable in and out (arrow 142) of the nip 120, and is translated with the cartridge 110 along plane 127.

As can be seen, there has been provided an imaging surface field reconditioning method and apparatus are provided for reconditioning, in the field, a marking material control pattern on an imaging surface of in an image producing machine. The imaging surface field reconditioning apparatus for practicing the method includes (a) an abrading device including an abrasive member having an abrasive surface; (b) a drive assembly for moving the imaging surface of the imaging member along a first plane; (b) a first moving device for moving the abrading surface of the abrading member into contact with the imaging surface for forming a surface reconditioning nip therewith; and (d) at least a second moving device for simultaneously moving the abrading surface along the first plane, and translating the abrading surface back and forth against said imaging surface along a second plane, for reconditioning the marking material control pattern on the imaging surface, thereby preventing marking material drawback during subsequent image formation, and thereby improving imaging quality While the embodiment of the present invention disclosed herein is preferred, it will be appreciated from this teaching that various alternative, modifications, variations or improvements therein may be made by those skilled in the art, which are intended to be encompassed by the following claims:

What is claimed is:

1. In an image producing machine including a controller and an imaging member having an imaging surface including a marking material control pattern thereon, a paper supply for supplying image receiving sheets, and an image transfer station, a method of reconditioning said imaging surface, the method comprising:

(a) moving said imaging surface of said imaging member along a first plane;

(b) cleaning release oil, marking material residue and debris from said imaging surface;

(c) moving an abrading surface of a surface reconditioning apparatus for forming a surface reconditioning nip against said imaging surface; and (d) simultaneously moving said abrading surface along said first plane and translating said abrading surface back and forth along a second plane against said imaging surface, for reconditioning said marking material control pattern on said imaging surface, thereby preventing marking material drawback during image formation and thereby improving imaging quality.

2. The method of claim 1, wherein said imaging surface is being moved in a first direction along said first plane.

3. The method of claim 1, wherein said imaging member comprises a drum and said imaging surface is being rotated along said first plane and in said first direction within said surface reconditioning nip.

4. The method of claim 1, wherein said cleaning function comprises operating the image producing machine without imaging on said imaging surface and without oiling said imaging surface, and running a number of blank sheets against said imaging surface through said image transfer station.

5. The method of claim 1, wherein moving said abrading surface comprises connecting said surface reconditioning apparatus to said controller and programming said surface reconditioning apparatus to be moved after a number of formed images.

6. The method of claim 1, wherein said surface reconditioning apparatus is moved at a second speed and in a second direction along said first plane.

7. The method of claim 6, wherein said second direction of said abrading surface is opposite to said first direction of said imaging surface.

8. The method of claim 1, wherein said imaging surface is being moved at a first speed along said first plane.

9. The method of claim 1, wherein said abrading surface comprises abrading media having a grit rating within a range of from about 200 to about 1200 for preventing polishing as well as excessive wearing of said imaging surface.

10. The method of claim 1, including a vacuum device mounted adjacent said abrading surface for removing abraded debris from said reconditioning nip.

11. An imaging surface field reconditioning apparatus for reconditioning in the field, a marking material control pattern on an imaging surface of in an image producing machine, the imaging surface field reconditioning apparatus comprising:

(a) an abrading device including an abrasive member having an abrasive surface;

(a) drive means for moving said imaging surface of said imaging member along a first plane;

(b) first moving means for moving said abrading surface of said abrading member into contact with said imaging surface for forming a surface reconditioning nip therewith; and (d) at least a second moving means for simultaneously moving said abrading surface along said first plane and translating said abrading surface back and forth along a second plane, for reconditioning said marking material control pattern on said imaging surface, thereby preventing marking material drawback during subsequent image formation, and improving imaging quality.

12. The imaging surface field reconditioning apparatus of claim 11, including a vacuum device mounted adjacent said abrading surface for removing abraded debris from said reconditioning nip.

13. The imaging surface field reconditioning apparatus of claim 11, wherein said abrading surface comprises abrading media having a grit rating within a range from 220 to 800 for preventing polishing as well as excessive wearing of said imaging surface.

14. The imaging surface field reconditioning apparatus of claim 11, wherein said abrading device comprises a cartridge mounted movably on rails within the image producing machine.

15. A phase change ink image producing machine comprising:

(a) a control subsystem for controlling operation of all subsystems and components of the image producing machine;

(b) a movable imaging member having an imaging surface including a marking material control pattern formed therein; and (c) an imaging drum maintenance assembly including a surface reconditioning apparatus for reconditioning said marking material control pattern on said imaging surface, said surface reconditioning apparatus including:

(i) an abrading device including an abrasive member having an abrasive surface;

(ii) drive means for moving said imaging surface of said imaging member along a first plane;

(iii) first moving means for moving said abrading surface of said abrading member into contact with said imaging surface for forming a surface reconditioning nip therewith; and (iv) at least a second moving means for simultaneously moving said abrading surface along said first plane and translating said abrading surface back and forth against said imaging surface along a second plane, for reconditioning said marking material control pattern on said imaging surface, thereby preventing marking material drawback during subsequent image formation, and improving imaging quality.

16. The phase change ink image producing machine of claim 15, including a vacuum device mounted adjacent said abrading surface for removing abraded debris from said reconditioning nip.

17. The phase change ink image producing machine of claim 16, wherein said vacuum device is movable into and out relative to said reconditioning nip.

18. The phase change ink image producing machine of claim 15, wherein said abrading surface comprises abrading media having a grit rating within a range of from about 200 to about 1200 for preventing polishing as well as excessive wearing of said imaging surface.

19. The phase change ink image producing machine of claim 15, wherein said abrading device comprises a cartridge mounted movably on rails within the image producing machine.

20. The phase change ink image producing machine of claim 15, wherein said second direction of said abrading surface is opposite said first direction of said imaging surface.

* * * * *

UNITED STATES PATENT AND TRADEMARK OFFICE

CERTIFICATE OF CORRECTION

PATENT NO. : 6,840,615 B2
APPLICATION NO. : 10/320828
DATED : January 11, 2005
INVENTOR(S) : Pan et al.

It is certified that error appears in the above-identified patent and that said Letters Patent is hereby corrected as shown below:

Title page,
Item [75], Inventors, "David A. Pan, Rochester, NY (US); Ralph A. Mosher, Rochester, NY (US); James E. Williams, Penfield, NY (US); Richard J. Blum, Webster, NY (US)." should read
-- David A. Pan, Rochester, NY (US); Ralph A. Mosher, Rochester, NY (US); James E. Williams, Penfield NY (US); Richard J. Blum, Webster, NY (US); Trevor J. Snyder, Newberg, OR (US). --.

Signed and Sealed this

Eleventh Day of July, 2006

JON W. DUDAS
*Director of the United States Patent and Trademark Office*